US011410616B2

(12) United States Patent
Meng et al.

(10) Patent No.: US 11,410,616 B2
(45) Date of Patent: Aug. 9, 2022

(54) BACKLIGHT DRIVING METHOD AND DEVICE OF DISPLAY PANEL, AND DISPLAY PANEL

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Zhaohui Meng, Beijing (CN); Hao Zhang, Beijing (CN); Dong Chen, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/615,476

(22) PCT Filed: Nov. 21, 2017

(86) PCT No.: PCT/CN2017/112146
§ 371 (c)(1),
(2) Date: Nov. 21, 2019

(87) PCT Pub. No.: WO2018/214429
PCT Pub. Date: Nov. 29, 2018

(65) Prior Publication Data

US 2020/0226986 A1 Jul. 16, 2020

(30) Foreign Application Priority Data

May 26, 2017 (CN) ..... 201710386831.0

(51) Int. Cl.
*G09G 3/34* (2006.01)
*G09G 3/36* (2006.01)

(52) U.S. Cl.
CPC ..... *G09G 3/3406* (2013.01); *G09G 3/3611* (2013.01); *G09G 2310/0237* (2013.01);
(Continued)

(58) Field of Classification Search
CPC ..... G09G 3/3406; G09G 3/3611; G09G 2320/0238; G09G 2320/0646; G09G 2310/0237
See application file for complete search history.

(56) References Cited

U.S. PATENT DOCUMENTS

2003/0001983 A1* 1/2003 Nose ..... G09G 3/3406 349/61
2003/0058229 A1* 3/2003 Kawabe ..... G09G 3/342 345/204

(Continued)

FOREIGN PATENT DOCUMENTS

CN 101315748 A 12/2008
CN 102572476 A 7/2012

(Continued)

OTHER PUBLICATIONS

International Search Report of PCT/CN2017/112146 in Chinese, dated Feb. 11, 2018, with English translation.

(Continued)

*Primary Examiner* — Ariel A Balaoing
(74) *Attorney, Agent, or Firm* — Collard & Roe, P.C.

(57) ABSTRACT

A backlight driving method and device of a display panel, and a display panel are provided. The backlight driving method of a display panel includes generating a synchronous drive frame and performing black frame insertion control according to a synchronous drive frame, the synchronous (Continued)

drive frame includes a first time region and a second time region, in the synchronous drive frame, a PWM light-adjusting signal is not output in the first time region and the PWM light-adjusting signal is output in the second time region, the first time region corresponds to line scan time, and the second time region corresponds to liquid crystal stabilization time.

20 Claims, 3 Drawing Sheets

(52) U.S. Cl.
CPC ..... *G09G 2320/0238* (2013.01); *G09G 2320/0646* (2013.01)

(56) References Cited

U.S. PATENT DOCUMENTS

2005/0007389 A1* 1/2005 Kumamoto ..... G09G 3/3406 345/690
2005/0248593 A1* 11/2005 Feng ..... G09G 3/3426 345/690
2006/0055661 A1* 3/2006 Kawaguchi ..... G09G 3/342 345/102
2007/0211014 A1 9/2007 Kim et al.
2007/0229432 A1* 10/2007 Kimura ..... G09G 3/3614 345/96
2007/0273678 A1* 11/2007 Okita ..... G09G 3/3648 345/204
2008/0238341 A1 10/2008 Korcharz et al.
2008/0297461 A1* 12/2008 Hsu ..... G09G 3/342 345/102
2009/0073110 A1* 3/2009 Feng ..... H05B 41/3927 345/102
2009/0243995 A1* 10/2009 Kimura ..... G09G 3/3648 345/102
2010/0123416 A1 5/2010 Lin et al.
2011/0164073 A1* 7/2011 Jung ..... G09G 3/342 345/690
2012/0081419 A1* 4/2012 Abe ..... G09G 3/3426 345/691
2012/0206579 A1* 8/2012 Wu ..... H04N 13/398 348/51
2012/0313846 A1* 12/2012 Zhang ..... G09G 3/342 345/102
2013/0033515 A1* 2/2013 Sakashita ..... G09G 3/3677 345/589
2015/0370371 A1 12/2015 Azumi et al.
2017/0110066 A1 4/2017 Luo et al.
2018/0018924 A1* 1/2018 Mao ..... G09G 3/3406

FOREIGN PATENT DOCUMENTS

CN 102572480 A 7/2012
CN 102646397 A 8/2012
CN 102800294 A 11/2012
CN 103500559 A 1/2014
CN 104050931 A 9/2014
CN 105374329 A 3/2016
CN 106652919 A 5/2017
CN 106981272 A 7/2017

OTHER PUBLICATIONS

Notice of Transmittal of the International Search Report of PCT/CN2017/112146 in Chinese, dated Feb. 11, 2018.
Written Opinion of the International Searching Authority of PCT/CN2017/112146 in Chinese, dated Feb. 11, 2018 with English translation.
Chinese Office Action in Chinese Application No. 201710386831.0, dated Oct. 29, 2018 with English translation.

* cited by examiner

BACKLIGHT DRIVING METHOD AND DEVICE OF DISPLAY PANEL, AND DISPLAY PANEL

CROSS REFERENCE TO RELATED APPLICATIONS

This application is the National Stage of PCT/CN2017/112146 filed on Nov. 21, 2017, which claims priority under 35 U.S.C. § 119 of Chinese Application No. 201710386831.0 filed on May 26, 2017, the disclosure of which is incorporated by reference.

TECHNICAL FIELD

Embodiments of the present disclosure relate to a backlight driving method and device of a display panel, and a display panel.

BACKGROUND

A Virtual Reality (VR) product refers to a product developed based on a virtual reality technology, for example, a VR head-mounted display. The virtual reality technology is a computer simulation technology that can create a virtual world and make an user to experience the virtual world, and use a computer to generate a simulation environment, which is a systematic simulation of multi-source information fusion of interactive three-dimensional dynamic view and physical behavior, so that users are immersed in the environment.

Virtual reality applications bring a strong sense of immersion; in most virtual reality scenes (such as game scenes), users can control characters they play to move freely, movement of the characters makes movement of a lens, and a relative position of a virtual reality content will also change when the lens moves. However, due to visual persistence of human eyes, images of a previous frame and a current frame will be retained by the human eyes, bringing a smear effect on the image in a liquid crystal display (LCD), and resulting in sensory conflict-caused vertigo.

In a related art, the vertigo is relieved mainly by controlling pixels within each frame of the liquid crystal display (LCD) to emit light within a very short time period. However, in the above-described mode, backlight is always in an ON-state when the image is displayed; during line scan and liquid crystal response inverting, a state of line scan and liquid crystal response inverting is easily felt by the human eyes, which makes a displayed motion image blurred on the one hand, and brings discomfort to the eyes on the other hand, thus affecting users' experience.

SUMMARY

Embodiments of the present disclosure provide a backlight driving method and device of a display panel, and a display panel.

In a first aspect, an embodiment of the present disclosure provides a backlight driving method, the backlight driving method comprises steps of: generating a synchronous drive frame and performing black frame insertion control according to the synchronous drive frame, the synchronous drive frame comprises a first time region and a second time region, in the synchronous drive frame, a PWM light-adjusting signal is not output in the first time region and the PWM light-adjusting signal is output in the second time region, the first time region corresponds to line scan time, and the second time region corresponds to liquid crystal stabilization time.

Alternatively, the generating the synchronous drive frame further includes acquiring the PWM light-adjusting signal.

Alternatively, the acquiring the PWM light-adjusting signal includes acquiring the PWM light-adjusting signal from a liquid crystal driver chip, and the generating the synchronous drive frame further includes acquiring the liquid crystal stabilization time and the line scan time from the liquid crystal driver chip.

Alternatively, the acquiring the PWM light-adjusting signal includes acquiring the PWM light-adjusting signal from a microprocessor, and the generating a synchronous drive frame further includes acquiring the liquid crystal stabilization time and the line scan time from the liquid crystal driver chip.

Alternatively, the generating the synchronous drive frame according to the PWM light-adjusting signal and the backlight modulation control signal includes associating the PWM light-adjusting signal with the backlight modulation control signal by a logic relationship "AND", to generate the synchronous drive frame.

Alternatively, a frequency of the synchronous drive frame is consistent with a display frequency of the display panel.

In a second aspect, an embodiment of the present disclosure provides a backlight driving device of a display panel, the backlight driving device of a display panel comprises: a first module, configured to output a PWM light-adjusting signal and a backlight modulation control signal, wherein, the backlight modulation control signal includes a first time region and a second time region, and the backlight modulation control signal is active in the second time region; a synchronous drive frame generating module, configured to generate a synchronous drive frame according to the PWM light-adjusting signal and the backlight modulation control signal, wherein, the synchronous drive frame comprises the first time region and the second time region therein; in the synchronous drive frame, the PWM light-adjusting signal is not output in the first time region, and the PWM light-adjusting signal is output in the second time region; the first time region corresponds to line scan time, and the second time region corresponds to liquid crystal stabilization time; and a backlight driver chip, configured to perform black frame insertion control according to the synchronous drive frame.

Alternatively, the first module is a liquid crystal driver chip.

Alternatively, the first module is configured to acquire the PWM light-adjusting signal and the backlight modulation control signal from the liquid crystal driver chip and then output the PWM light-adjusting signal and the backlight modulation control signal.

Alternatively, the first module is configured to acquire the PWM light-adjusting signal from a microprocessor and acquire the backlight modulation control signal from the liquid crystal driver chip and then output the PWM light-adjusting signal and the backlight modulation control signal.

Alternatively, the synchronous drive frame generating module is an AND gate.

Alternatively, a frequency of the synchronous drive frame is consistent with a display frequency of the display panel.

In a third aspect, an embodiment of the present disclosure provides a display panel, the display panel includes: the backlight driving device of a display panel according to the second aspect of the present disclosure; a backlight, configured to be driven by the backlight driving device; and a display screen, configured to display an image.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAILED DESCRIPTION

Figure 1:
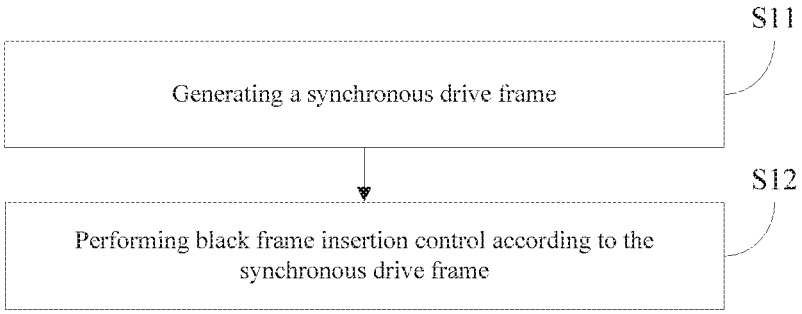
FIG. 1 is a flow chart of a backlight driving method of a display panel according to an embodiment of the present disclosure.

Embodiments of the present disclosure will be in detail described hereinafter, and examples of the embodiments am shown in the drawings, in which the same or similar reference number is denoted as the same or similar members or the members with the same or similar function throughout. The described embodiments in conjunction with the accompanying drawings of the present disclosure are exemplary, only is used to explain the present disclosure and do not intend to limit the present disclosure.

Hereinafter, a backlight driving method and device of a display panel, and a display panel according to the embodiments of the present disclosure are described with reference to the accompanying drawings.

FIG. 1 is a flow chart of a backlight driving method of a display panel according to an embodiment of the present disclosure. Wherein, it should be noted that, the display panel according to this embodiment may be applied to a VR product (for example, a VR head-mounted display).

As shown in FIG. 1, the backlight driving method of a display panel according to the embodiment of the present disclosure comprises steps of:

S11: generating a synchronous drive frame.

Wherein, the synchronous drive frame has a first time region and a second time region, the synchronous drive frame does not have a Pulse Width Modulation (PWM) light-adjusting signal output in the first time region, and has the PWM light-adjusting signal output in the second time region.

In the VR product, a display process of the display panel may be generally divided into several time periods, and a VR display process is usually divided into line scan time, liquid crystal response time and liquid crystal stabilization time. In order to implement backlight control of the display panel, in this embodiment, the first time region of the synchronous drive frame corresponds to the line scan time, and the second time region corresponds to the liquid crystal stabilization time.

Here, it should be noted that the line scan time is a sum of scan time of all lines of one frame; usually, the liquid crystal response time is shorter than the liquid crystal stabilization time, and the liquid crystal response time overlaps with the line scan time.

Wherein, the line scan time is related to a scanning capability of a liquid crystal driver chip in the display panel, that is, the line scan time is limited by the scanning capability of the liquid crystal driver chip in the display panel, usually, the stronger the scanning capability of the liquid crystal driver chip, the shorter the line scan time required.

Wherein, it should be noted that, in one embodiment of the present disclosure, a frequency of a synchronous drive frame is consistent with a display frequency of a display panel.

Wherein, the display frequency of the display panel refers to the number of times the image on the display panel appears every second, the higher the display frequency of the display panel, the weaker the flicker sense of the image on the display panel, the better the stability, and the stronger the protection of vision.

In one embodiment of the present disclosure, in order to improve a response speed of a display panel, a display frequency of the display panel according to this embodiment is a frequency greater than or equal to a preset frequency threshold.

Wherein, the preset frequency threshold is set in advance, for example, the preset frequency threshold may be 90 Hz.

Wherein, it should be understood that display frequencies corresponding to different display panels are different, and the display frequency of the display panel is preset and standardized by a device manufacturer of the display panel.

Figure 2:
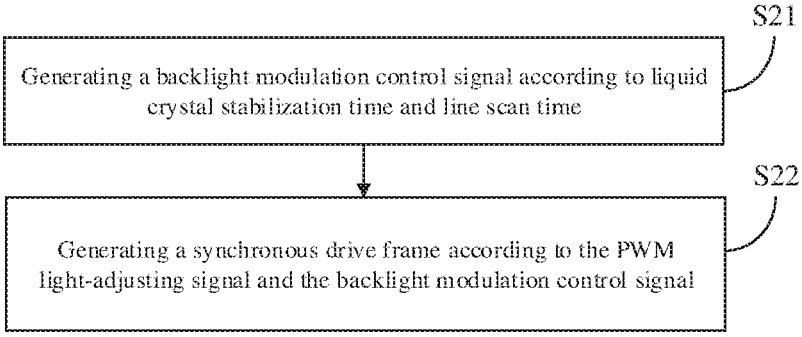
FIG. 2 is an exemplary flow chart of generating a synchronous drive frame.

In one embodiment of the present disclosure, a process of generating a synchronous drive frame, as shown in FIG. 2, may include:

S21: generating a backlight modulation control signal according to liquid crystal stabilization time and line scan time.

Wherein, the backlight modulation control signal includes a first time region and a second time region, and the backlight modulation control signal is active in the second time region.

Wherein, it may be determined through the above description that, the first time region corresponds to the line scan time, and the second time region corresponds to the liquid crystal stabilization time, that is to say, the backlight modulation control signal is active only in the liquid crystal stabilization time, that is, backlight of a display panel is in an OFF-state within the line scan time, and the backlight is in an ON-state within the liquid crystal stabilization time.

As an exemplary implementation mode, in order that average brightness of a liquid crystal display module after backlight modulation satisfies requirements of human eyes, a ratio of the second time region may be set above a preset percentage.

Wherein, the preset percentage is set in advance, for example, the preset percentage may be 10%.

Exemplarily, if a display frequency of the display panel is 90 Hz, then average time per frame is 11.1 ms; in order that the average brightness of the liquid crystal display module after backlight modulation satisfies the requirements of the human eyes, the second time region may be set above 10%, that is, time for the ON-state of the backlight is set above 10%, at which time, the liquid crystal display time in a liquid crystal driver chip needs to be controlled within 9 ms.

As an exemplary implementation mode, in order to set the ratio of the second time region above the preset percentage, that is, in order to control the liquid crystal display time within a preset time, the display panel may be controlled in a video mode, then, an OSCillator (OSC) of the liquid crystal driver chip is overclocked, and Vertical Back Porch (VBP) and Vertical Front Porch (VFP) are adjusted to compress display scan time, so that the liquid crystal display time may be controlled within the preset time.

Wherein, the VBP refers to the number of invalid lines at beginning of a frame after a vertical synchronization cycle. VFP refers to the number of invalid lines from ending of current frame data output to beginning of a vertical synchronization cycle of a next frame.

S22: generating a synchronous drive frame according to the PWM light-adjusting signal and the backlight modulation control signal acquired.

Alternatively, the generating a synchronous drive frame may further include: acquiring the PWM light-adjusting signal; for example, the PWM light-adjusting signal may be acquired from the liquid crystal driver chip, or may be obtained from a microprocessor of a mobile phone, a tablet, or the like, as long as the PWM light-adjusting signal can be acquired, which will not be limited in the embodiment of the present disclosure.

For example, the acquiring the PWM light-adjusting signal may include: acquiring the PWM light-adjusting signal from the liquid crystal driver chip; and the generating a synchronous drive frame may further include: acquiring the liquid crystal stabilization time and the line scan time from the liquid crystal driver chip.

Alternatively, the acquiring the PWM light-adjusting signal may include: acquiring the PWM light-adjusting signal from a microprocessor; and the generating a synchronous drive frame may further include: acquiring the liquid crystal stabilization time and the line scan time from the liquid crystal driver chip.

In one embodiment of the present disclosure, in order that a synchronous drive frame has a backlight control function and a brightness adjustment function, and that the synchronous drive frame and the liquid crystal driver chip are synchronized in periodic driving control, that is, the synchronous drive frame drives and stops a backlight operation at a specific time of each frame, after the backlight modulation control signal and the PWM light-adjusting signal are acquired, the PWM light-adjusting signal and the backlight modulation control signal may be associated with each other by a logic relationship "AND", to generate the synchronous drive frame.

Figure 3A:
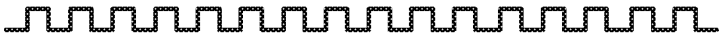
FIG. 3*a* is an exemplary diagram of a PWM light-adjusting signal.
Figure 3B:
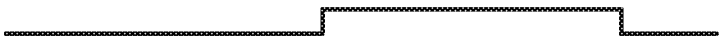
FIG. 3*b* is an exemplary diagram of a backlight modulation control signal.
Figure 3C:
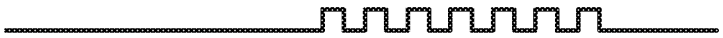
FIG. 3*c* is an exemplary diagram of a synchronous drive frame.

Exemplarily, it is assumed that the acquired PWM light-adjusting signal is as shown in FIG. 3*a*, the backlight modulation control signal generated according to the liquid crystal stabilization time and the line scan time is as shown in FIG. 3*b*, and after the PWM light-adjusting signal and the backlight modulation control signal are associated with each other by the logic relationship "AND", the synchronous drive frame generated thereby is as shown in FIG. 3*c*.

S12: performing black frame insertion control according to the synchronous drive frame.

In one embodiment of the present disclosure, a synchronous drive frame controls backlight to stop operation at a specific time, for example, in a first time region, to implement a black frame insertion operation, and controls the backlight to be lit in a second time region, so as to implement a black frame insertion operation of entire display.

Moreover, in this embodiment, the OFF-state of the backlight, that is, a time period corresponding to black frame insertion is the same as the first time region, that is, the time period corresponding to black frame insertion corresponds to line scan time.

Wherein, it should be noted that, for convenience of description, the time period corresponding to black frame insertion is simply referred to as black frame insertion time.

Figure 4A:
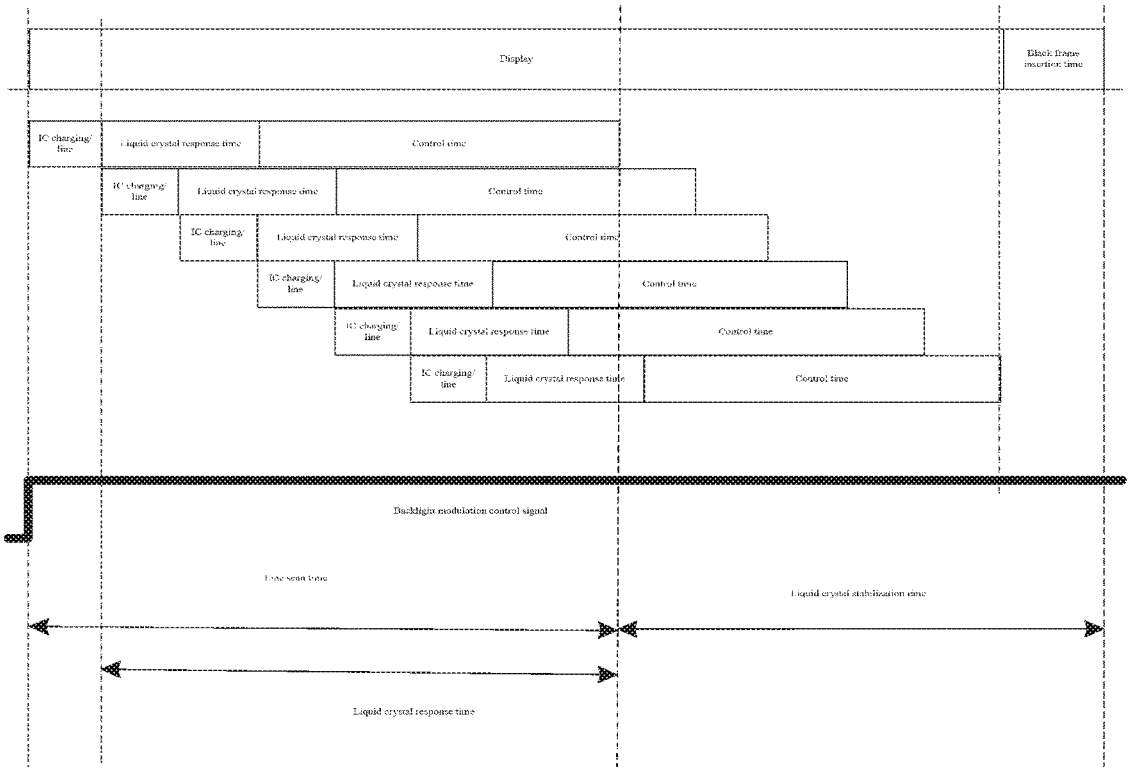
FIG. 4*a* is an exemplary diagram of scan time, liquid crystal response time and liquid crystal stabilization time, backlight modulation control signal, and black frame insertion time known to the inventor(s)
Figure 4B:
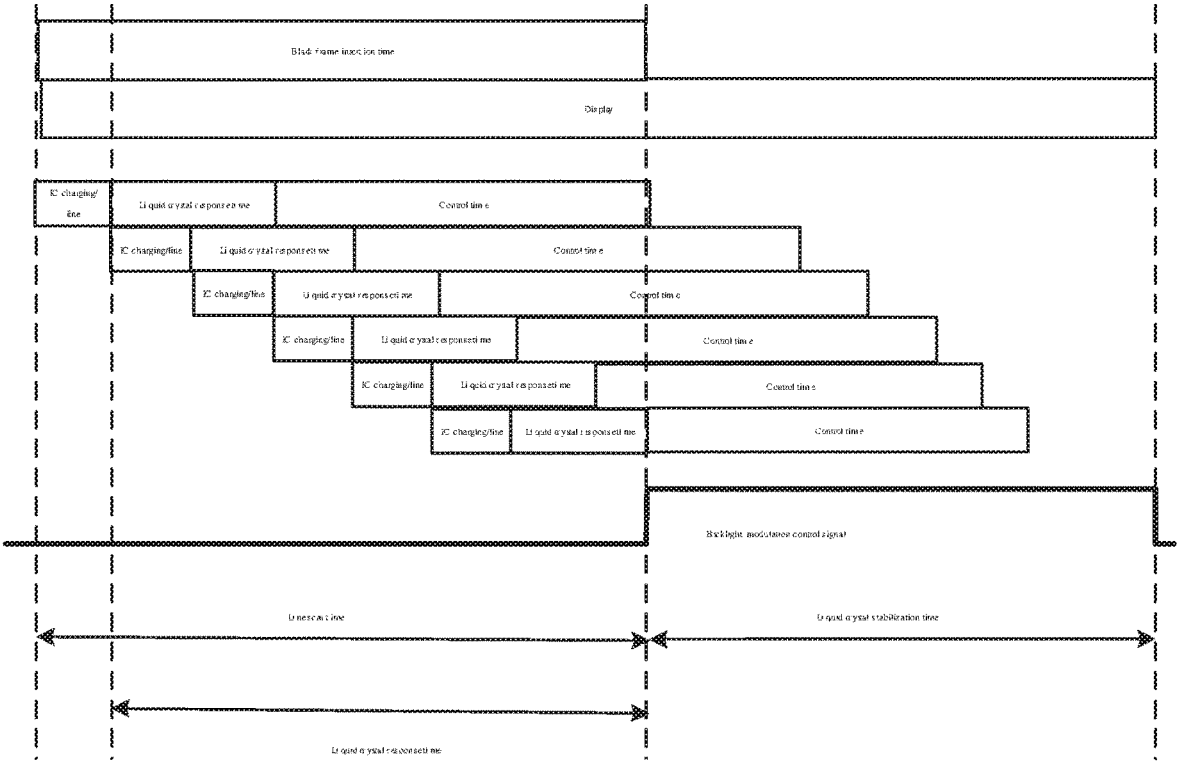
FIG. 4*b* is an exemplary diagram of scan time, liquid crystal response time and liquid crystal stabilization time, backlight modulation control signal, and black frame insertion time according to the embodiment.

Exemplarily, an exemplary diagram of the line scan time, the liquid crystal response time and the liquid crystal stabilization time, the backlight modulation control signal, and the black frame insertion time of the display that are known to the inventor(s) is as shown in FIG. 4*a*; and an exemplary diagram of the line scan time, the liquid crystal response time and the liquid crystal stabilization time, the backlight modulation control signal, and the black frame insertion time in the backlight driving method used in this embodiment is as shown in FIG. 4*b*; by comparing FIG. 4*a* with FIG. 4*b*, it can be seen that, in this embodiment, the backlight is turned-on in the liquid crystal stabilization time, the backlight is turned-off in both the line scan time and the liquid crystal response time; by turning off the backlight within the line scan time and the liquid crystal response time, a state of a liquid crystal within the line scan time and the liquid crystal response time may be hid, and thus a inverting state of the liquid crystal is not felt by the human eyes, and discomfort that the liquid crystal display module brings to the eyes is mitigated.

In summary, it can be seen that, in this embodiment, in the process of performing black frame insertion according to the synchronous drive frame, the PWM light-adjusting signal is controlled to be output within the liquid crystal stabilization time, to turn-on the backlight, complete display, and implement a backlight black frame insertion function within the frame; and at a same time, brightness of the liquid crystal within the liquid crystal stabilization time is controlled, so that on the one hand, the inverting state of the liquid crystal is not felt by the human eyes, to mitigate discomfort that the liquid crystal display module brings to the eyes, and on the other hand, a trajectory of a motion image displayed by the display panel may be more realistic, to improve clarity of the motion image.

In the backlight driving method of the display panel according to the embodiment of the present disclosure, the synchronous drive frame controls not to output the PWM light-adjusting signal within the line scan time, and to output the PWM light-adjusting signal within the liquid crystal stabilization time, and black frame insertion control is performed according to the synchronous drive frame, so that the inverting state of the liquid crystal is not felt by the human eyes, to mitigate discomfort that the liquid crystal display module brings to the eyes, and at a same time, the trajectory of the motion image displayed by the display panel may be more realistic, to improve clarity of the motion image.

In order to implement the above-described embodiment, the present disclosure further proposes a backlight driving device of a display panel.

Figure 5:
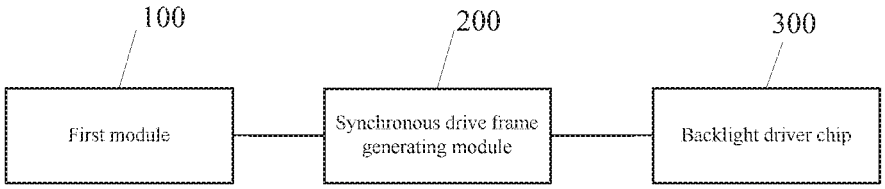
FIG. 5 is a structural schematic diagram of a backlight driving device of a display panel according to an embodiment of the present disclosure.

FIG. 5 is a structural schematic diagram of a backlight driving device of a display panel according to an embodiment of the present disclosure.

As shown in FIG. 5, the backlight driving device of the display panel according to the embodiment of the present disclosure comprises a first module 100, a synchronous drive frame generating module 200 and a backlight driver chip 300, wherein:

The first module 100 is configured to output a PWM light-adjusting signal and a backlight modulation control signal.

Alternatively, the first module 100 may acquire a PWM light-adjusting signal, and then output the same. For example, the first module 100 may acquire a PWM light-adjusting signal from a liquid crystal driver chip, or may acquire from a mobile phone, a tablet personal computer, or a microprocessor of other VR device, as long as the PWM light-adjusting signal can be acquired, which will not be limited in the embodiment of the present disclosure. Moreover, the first module 100 may further acquire line scan time, liquid crystal response time and liquid crystal stabilization time of the display panel, for example, from the liquid crystal driver chip or other components, and generate a backlight modulation control signal according to the above and output the backlight modulation control signal.

Alternatively, the first module 100 itself may provide a PWM light-adjusting signal and then output the PWM light-adjusting signal. In this case, the first module 100 may be a liquid crystal driver chip that can provide the PWM light-adjusting signal, and the first module 100 may provide the line scan time, the liquid crystal response time and the liquid crystal stabilization time, and generate a backlight modulation signal according to the line scan time, the liquid crystal response time and the liquid crystal stabilization time provided by itself, and then output the backlight modulation signal.

Wherein, the backlight modulation control signal includes a first time region and a second time region, and the backlight modulation control signal is valid in the second time region.

The synchronous drive frame generating module 200 is configured to generate a synchronous drive frame according to the PWM light-adjusting signal and the backlight modulation control signal.

Wherein, the synchronous drive frame has a first time region and a second time region therein; and the synchronous drive frame does not have the PWM light-adjusting signal output in the first time region, and has the PWM light-adjusting signal output in the second time region.

The first time region corresponds to the line scan time, and the second time region corresponds to the liquid crystal stabilization time.

Wherein, the line scan time is related to a scanning capability of a liquid crystal driver chip in the display panel, that is, the line scan time is limited by the scanning capability of the liquid crystal driver chip in the display panel; usually, the stronger the scanning capability of the liquid crystal driver chip, the shorter the line scan time required.

The backlight driver chip 300 is configured to perform black frame insertion control according to the synchronous drive frame.

In one embodiment of the present disclosure, a synchronous drive frame generating module 200 is an AND gate.

In one embodiment of the present disclosure, a frequency of a synchronous drive frame is consistent with a display frequency of a display panel.

Wherein, it should be understood that, display frequencies corresponding to different display panels are different, and the display frequency of the display panel is preset and standardized by a device manufacturer of the display panel.

Figure 6:
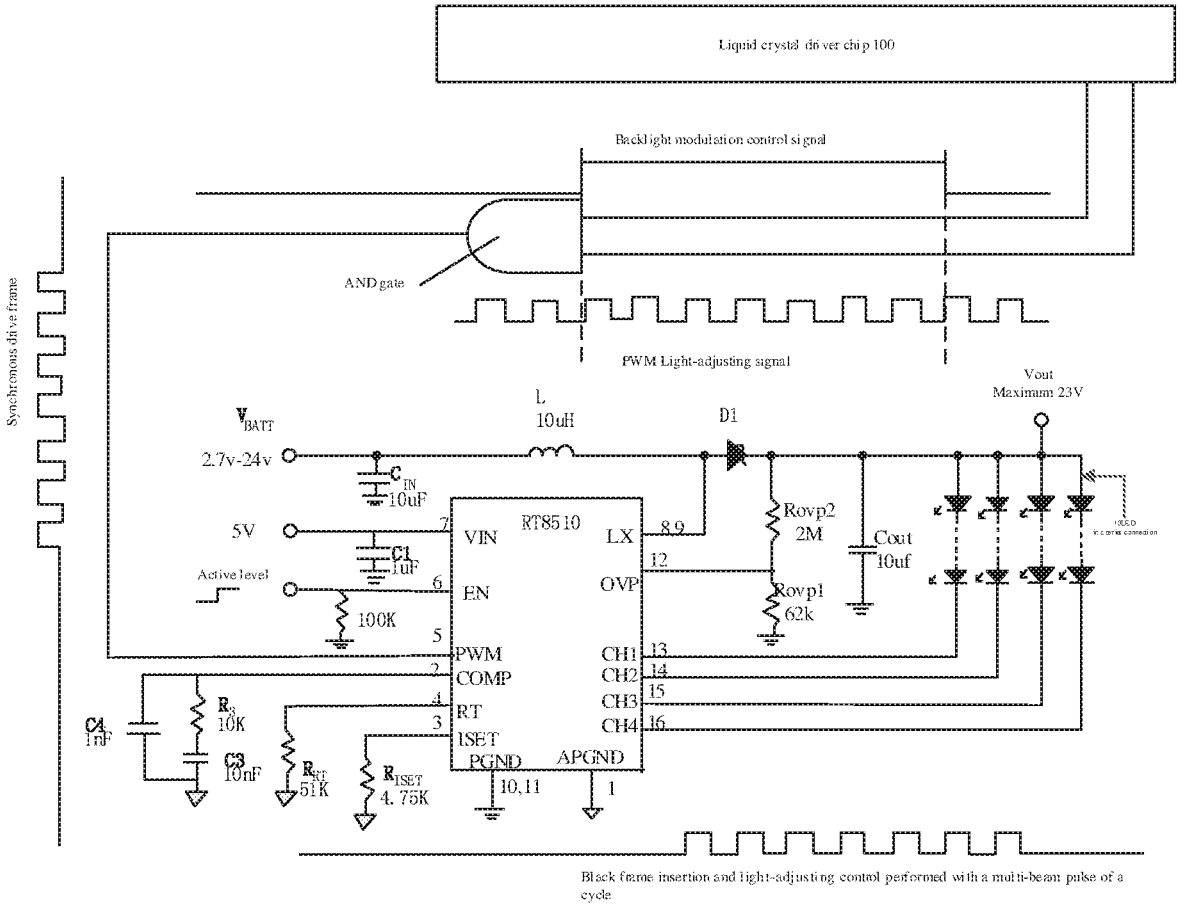
FIG. 6 is an exemplary diagram of a backlight driving device of a display panel according to a specific embodiment of the present disclosure.

In one example, an exemplary diagram of a backlight driving device of a display panel is as shown in FIG. 6, a first module 100 may be a liquid crystal driver chip 100; after a backlight modulation control signal is generated according to line scan time and liquid crystal stabilization time of the liquid crystal driver chip, and a PWM light-adjusting signal of the liquid crystal driver chip is acquired, the backlight modulation control signal and the PWM light-adjusting signal of the liquid crystal driver chip are associated with each other by a logic relationship "AND" through an AND gate, to generate a synchronous drive frame; and the synchronous drive frame is input into a backlight driver chip 300 through a PWM pin, so that the backlight driver chip 300 performs black frame insertion and light-adjusting control with a multi-beam pulse of a cycle in the synchronous drive frame.

Wherein, it should be noted that, the foregoing explanation of the backlight driving method of the display panel is also applicable to the backlight driving device of the display panel according to this embodiment, which will not be repeated here.

In the backlight driving device of the display panel according to the embodiment of the present disclosure, the synchronous drive frame controls not to output the PWM light-adjusting signal within the line scan time, and to output the PWM light-adjusting signal within the liquid crystal stabilization time, and black frame insertion control is performed according to the synchronous drive frame, so that an inverting state of a liquid crystal is not felt by human eyes, to mitigate discomfort that a liquid crystal display module brings to the eyes, and at a same time, a trajectory of a motion image displayed by the display panel may be more realistic, to improve clarity of the motion image.

In order to implement the above-described embodiment, the present disclosure further proposes a display panel.

The display panel comprises the backlight driving device of the display panel according to the above-described embodiment; a backlight, configured to be driven by the backlight driving device; and a display screen, configured to display an image.

In the display panel according to the embodiment of the present disclosure, a synchronous drive frame controls not to output a PWM light-adjusting signal within line scan time, and to output a PWM light-adjusting signal within liquid crystal stabilization time, and black frame insertion control is performed according to the synchronous drive frame, so that an inverting state of a liquid crystal is not felt by human eyes, to mitigate discomfort that a liquid crystal display module brings to the eyes, and at a same time, a trajectory of a motion image displayed by the display panel may be more realistic, to improve clarity of the motion image.

In the backlight driving method and device of the display panel, and the display panel according to the embodiments of the present disclosure, the synchronous drive frame controls not to output the PWM light-adjusting signal within the line scan time, and to output the PWM light-adjusting signal within the liquid crystal stabilization time, and black frame insertion control is performed according to the synchronous drive frame, so that the inverting state of the liquid crystal is not felt by the human eyes, to mitigate discomfort that the liquid crystal display module brings to the eyes, and at a same time, the trajectory of the motion image displayed by the display panel may be more realistic, to improve clarity of the motion image.

In the description, the description with referring to the terms "an embodiment", "some embodiments", "example", "specific example" or "some examples" means that the specific feature, structure, material or character described with connection with the embodiment or example is included in at least one embodiment or example of the present disclosure. In the description, the schematic description of the above terms is not necessary to direct to the same embodiment or example. The described feature, structure, material or character may be combined in any suitable manner in any or a plurality of embodiments or examples. Further, in case of no conflict, different embodiments or examples and features in different embodiments or example described in the specification can be combined.

Further, the terms, such as "first," "second," or the like, which are used in the description and the claims of the present disclosure, are not intended to indicate or imply the relative importance or implicitly indicate the amount of the features. Thus, the features defined by "first," "second," may explicitly indicate or implicitly includes at least one feature. In the description of the present disclosure, Unless otherwise defined, "a plurality of" means two or more.

Any process or method illustrated in the flow charts or described herein in any other manner may be understood as including one or a plurality of modules, segments or portions of codes of executable instructions for implementing specific logic functions or steps in the processes; in addition, the scope of the preferred embodiments of the present disclosure covers other implementations, wherein, the implementation of the functions may not be subjected to the illustrated or discussed sequence; however, the functions may be implemented in a substantially simultaneous manner or in a contrary sequence according to the involved functions, which shall be understood by those skilled in the art according to the embodiments of the present disclosure.

The logic and/or step illustrated in the flow charts or described herein in any other manner, for example, may be considered as a particular sequence table of executable instructions for implementing the logic functions, and may be specifically implemented in any computer readable medium to be used by an instruction execution system, a device or an apparatus (for example, a system based on computers, a system including processors or other systems capable of obtaining the instruction from the instruction execution system, device and apparatus and executing the instruction), or to be used in combination with the instruction execution system, the device and the apparatus. As to the specification, the "computer readable medium" may be any device adaptive for including, storing, communicating, propagating or transferring programs to be used by or in combination with the instruction execution system, the device or the apparatus. More specific examples of the computer readable medium include but are not limited to: an electronic connection part (an electronic device) with one or more wires, a portable computer enclosure (a magnetic device), a random access memory (RAM), a read only memory (ROM), an erasable programmable read-only memory (EPROM or a flash memory), an optical fiber device and a portable compact disk read-only memory (CDROM). In addition, the computer readable medium may even be a paper or other appropriate medium capable of printing programs thereon, this is because, for example, the paper or other appropriate medium may be optically scanned and then edited, decrypted or processed by using other appropriate methods when necessary to obtain the programs in an electric manner, and then the programs may be stored in the computer memories.

It should be understood that, respective parts of the present disclosure may be implemented by hardware, software, firmware or a combination thereof. In the above implementation modes, a plurality of steps or methods may be implemented by software or firmware that is stored in the memory and executed by an appropriate instruction execution system. For example, if it is implemented by hardware, it may be implemented by any one of the following technologies known in the art or a combination thereof as in another implementation mode: a discrete logic circuit(s) having logic gates for implementing logic functions upon data signals, an Application Specific Integrated Circuit having appropriate combinational logic gates, a Programmable Gate Array (PGA), a Field Programmable Gate Array (FPGA), etc.

Those ordinarily skilled in the art may understand that all or part of steps carried by the method for implementing the above-described embodiments may be completed by a relevant hardware instructed by a program. The programs may be stored in a computer readable storage medium, and the programs include any one or a combination of the steps according the method embodiments when being executed.

In addition, respective functional units in respective embodiments of the present disclosure may be integrated in a processing module, or respective unit may further exist physically alone, or two or more units may further be integrated in a module. The foregoing integrated module may be implemented either in the form of hardware or software. If the integrated module is implemented as a software functional module and is sold or used as a standalone product, it may also be stored in a computer readable storage medium.

The above-mentioned storage medium may be a read only memory (ROM), a magnetic disk or an optical disk, and the like. Although the embodiments of the present disclosure have been shown and described above, it should be understood that the above-described embodiments are exemplary, and it would be appreciated by those ordinarily skilled in the art that the above-described embodiments cannot be construed to limit the present disclosure, and variations, modifications, substitutions and transformations can be made in the above-described embodiments within the scope of the present disclosure.

The application claims priority to the Chinese patent application No. 201710386831.0, filed May 26, 2017, the disclosure of which is incorporated herein by reference as part of the application.

The invention claimed is:

1. A backlight driving method of a display panel, comprising:

generating a synchronous drive frame, wherein, the synchronous drive frame comprises a first time region and a second time region, in the synchronous drive frame, a PWM light-adjusting signal is not output in the first time region, and the PWM light-adjusting signal is output in the second time region, the first time region corresponds to line scan time, and the second time region corresponds to liquid crystal stabilization time; and performing black frame insertion control according to the synchronous drive frame, wherein a black frame insertion time is identical to the line scan time and the first time region, in the first time region, a backlight is in an OFF-state, in all period of the line scan time which is identical to the black frame insertion time, all backlight units of the backlight are in the OFF-state from beginning to end of the line scan time, and the line scan time comprises a period in which data for displaying an image is applied to all display pixel units of the display panel, wherein the black frame insertion time, the line scan time for writing the data for displaying an image and the first time region initiate at a same point in time, the black frame insertion time, the line scan time for writing the data for displaying an image and the first time region end at a same point in time, the black frame insertion time, the line scan time for writing the data for displaying an image and the first time region are identical are a same duration.

2. The backlight driving method of the display panel according to claim 1, wherein, the generating the synchronous drive frame includes:

generating a backlight modulation control signal according to the liquid crystal stabilization time and the line scan time, the backlight modulation control signal including the first time region and the second time region, and the backlight modulation control signal being active in the second time region; and generating the synchronous drive frame according to the PWM light-adjusting signal and the backlight modulation control signal.

3. The backlight driving method of the display panel according to claim 2, wherein, the generating the synchronous drive frame further includes:

acquiring the PWM light-adjusting signal.

4. The backlight driving method of the display panel according to claim 3, wherein, the acquiring the PWM light-adjusting signal includes:

acquiring the PWM light-adjusting signal from a liquid crystal driver chip; and the generating the synchronous drive frame further includes:

acquiring the liquid crystal stabilization time and the line scan time from the liquid crystal driver chip.

5. The backlight driving method of the display panel according to claim 3, wherein, the acquiring the PWM light-adjusting signal includes:

acquiring the PWM light-adjusting signal from a microprocessor; and the generating a synchronous drive frame further includes:

acquiring the liquid crystal stabilization time and the line scan time from the liquid crystal driver chip.

6. The backlight driving method of the display panel according to claim 2, wherein, the generating the synchronous drive frame according to the PWM light-adjusting signal and the backlight modulation control signal includes:

associating the PWM light-adjusting signal with the backlight modulation control signal by a logic relationship "AND", to generate the synchronous drive frame.

7. The backlight driving method of the display panel according to claim 1, wherein, a frequency of the synchronous drive frame is consistent with a display frequency of the display panel.

8. A backlight driving device of a display panel, comprising:

a first module, configured to output a PWM light-adjusting signal and a backlight modulation control signal, wherein, the backlight modulation control signal includes a first time region and a second time region, and the backlight modulation control signal is active in the second time region;

a synchronous drive frame generating module, configured to generate a synchronous drive frame according to the PWM light-adjusting signal and the backlight modulation control signal, wherein, the synchronous drive frame comprises the first time region and the second time region therein; in the synchronous drive frame, the PWM light-adjusting signal is not output in the first time region, and the PWM light-adjusting signal is output in the second time region; the first time region corresponds to line scan time, and the second time region corresponds to liquid crystal stabilization time; and a backlight driver chip, configured to perform black frame insertion control according to the synchronous drive frame, wherein a black frame insertion time is identical to the line scan time and the first time region, in the first time region, a backlight is in an OFF-state, in all period of the line scan time which is identical to the black frame insertion time, all backlight units of the backlight are in the OFF-state from beginning to end of the line scan time, and the line scan time comprises a period in which data for displaying an image is applied to all display pixel units of the display panel, wherein the black frame insertion time, the line scan time for writing the data for displaying an image and the first time region initiate at a same point in time, the black frame insertion time, the line scan time for writing the data for displaying an image and the first time region end at a same point in time, the black frame insertion time, the line scan time for writing the data for displaying an image and the first time region are identical are a same duration.

9. The backlight driving device of the display panel according to claim 8, wherein, the first module is a liquid crystal driver chip.

10. The backlight driving device of the display panel according to claim 8, wherein, the first module is configured to acquire the PWM light-adjusting signal and the backlight modulation control signal from the liquid crystal driver chip and then output the PWM light-adjusting signal and the backlight modulation control signal.

11. The backlight driving device of the display panel according to claim 8, wherein, the first module is configured to acquire the PWM light-adjusting signal from a microprocessor and acquire the backlight modulation control signal from the liquid crystal driver chip and then output the PWM light-adjusting signal and the backlight modulation control signal.

12. The backlight driving device of the display panel according to claim 8, wherein, the synchronous drive frame generating module is an AND gate.

13. The backlight driving device of the display panel according to claim 8, wherein, a frequency of the synchronous drive frame is consistent with a display frequency of the display panel.

14. A display panel, comprising:

the backlight driving device according to claim 8;

a backlight, configured to be driven by the backlight driving device; and a display screen, configured to display an image.

15. The backlight driving method of the display panel according to claim 3, wherein, the generating the synchronous drive frame according to the PWM light-adjusting signal and the backlight modulation control signal includes:

associating the PWM light-adjusting signal with the backlight modulation control signal by a logic relationship "AND", to generate the synchronous drive frame.

16. The backlight driving method of the display panel according to claim 4, wherein, the generating the synchronous drive frame according to the PWM light-adjusting signal and the backlight modulation control signal includes:

associating the PWM light-adjusting signal with the backlight modulation control signal by a logic relationship "AND", to generate the synchronous drive frame.

17. The backlight driving method of the display panel according to claim 5, wherein, the generating the synchronous drive frame according to the PWM light-adjusting signal and the backlight modulation control signal includes:

associating the PWM light-adjusting signal with the backlight modulation control signal by a logic relationship "AND", to generate the synchronous drive frame.

18. The backlight driving device of the display panel according to claim 9, wherein, the synchronous drive frame generating module is an AND gate.

19. The backlight driving device of the display panel according to claim 10, wherein, the synchronous drive frame generating module is an AND gate.

20. The backlight driving device of the display panel according to claim 11, wherein, the synchronous drive frame generating module is an AND gate.

* * * * *